US005109660A

United States Patent [19]

Reyer et al.

[11] Patent Number: 5,109,660

[45] Date of Patent: May 5, 1992

[54] APPARATUS AND METHOD FOR INCREMENTALLY SHIFTING A YARN-CARRYING MEMBER ALONG A SPINNING TUBE IN A TEXTILE SPINNING OR TWISTING OPERATION

[75] Inventors: Herbert Reyer, Ebersbach/Fils; Thomas Peter, Esslingen, both of Fed. Rep. of Germany

[73] Assignee: Zinser Textilmaschinen GmbH, Ebersbach/Fils, Fed. Rep. of Germany

[21] Appl. No.: 508,353

[22] Filed: Apr. 12, 1990

[30] Foreign Application Priority Data

Apr. 17, 1989 [DE] Fed. Rep. of Germany ..... 3912592

[51] Int. Cl.[5] ..... D01H 13/00; B65H 54/28

[52] U.S. Cl. ..... 57/95; 242/26.4; 242/26.45

[58] Field of Search ..... 57/92-99, 57/75, 264; 242/26.1, 26.4, 26.45

[56] References Cited

U.S. PATENT DOCUMENTS

| | | | |
|---|---|---|---|
| 678,408 | 7/1901 | Lengweiler | 242/26.45 |
| 726,570 | 4/1903 | Purcell | 242/26.45 |
| 1,091,015 | 3/1914 | Poisson | 242/26.45 |
| 1,095,458 | 5/1914 | Cuttill et al. | 242/26.45 |
| 1,141,876 | 6/1915 | Lanning | 242/26.45 |
| 3,347,475 | 10/1967 | Steinberg | 242/26.4 |
| 3,477,654 | 11/1969 | Tonnies | 57/99 |
| 4,359,858 | 11/1982 | Wolf | 57/98 X |
| 4,944,143 | 7/1990 | Tanaka | 57/95 X |

FOREIGN PATENT DOCUMENTS

| | | | |
|---|---|---|---|
| 1006765 | 4/1957 | Fed. Rep. of Germany . | |
| 3706513 | 9/1987 | Fed. Rep. of Germany . | |
| 3717749 | 12/1988 | Fed. Rep. of Germany . | |
| 3732052 | 4/1989 | Fed. Rep. of Germany . | |
| 267194 | 5/1989 | Fed. Rep. of Germany | 57/95 |
| 267271 | 5/1989 | Fed. Rep. of Germany | 57/95 |
| 267272 | 5/1989 | Fed. Rep. of Germany | 57/95 |
| 267273 | 5/1989 | Fed. Rep. of Germany | 57/95 |

*Primary Examiner*—Daniel P. Stodola
*Assistant Examiner*—Michael R. Mansen
*Attorney, Agent, or Firm*—Shefte, Pinckney & Sawyer

[57] ABSTRACT

A control system for a ring spinning machine and method wherein yarn is wound in cop-type manner on spinning tubes supported on spindles driven at relatively lower speeds during the beginning and ending stages of the winding operation and relatively greater speeds during the intervening stage of the winding operation. Yarn is applied to the spinning tubes by reciprocating a ring rail or other yarn-carrying member along the spinning tubes with the extent of the reciprocating motion of the ring rail being incrementally shifted along the spinning tubes over the course of the winding operation. The present control system performs the shifting of the ring rail in relatively shorter increments during the intervening stage of the winding operation when spindle speed is relatively increased than during the beginning and ending stages of the winding operation when spindle speed is relatively decreased, which maximizes the yarn capacity of the spinning tubes.

10 Claims, 2 Drawing Sheets

Fig. 1
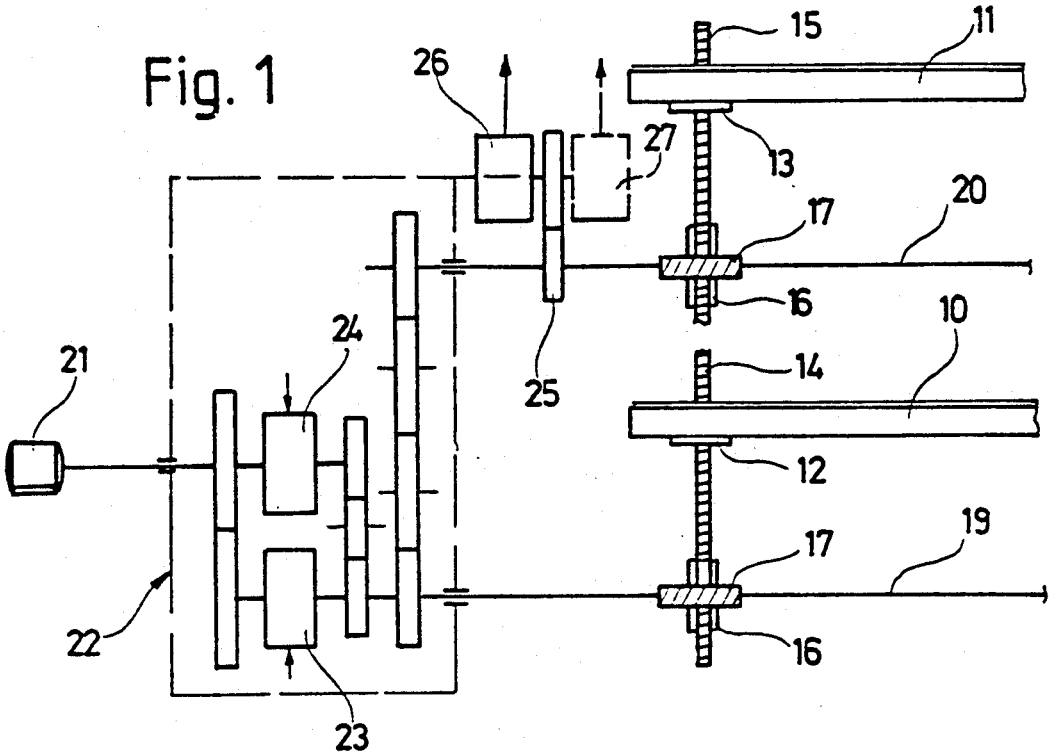
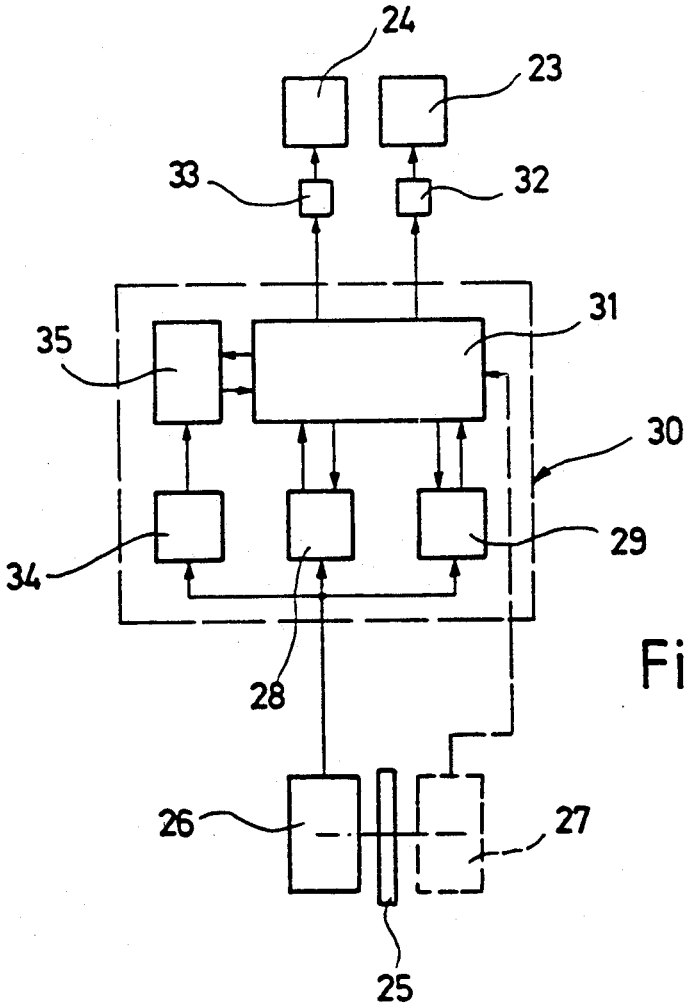
Fig. 2

APPARATUS AND METHOD FOR INCREMENTALLY SHIFTING A YARN-CARRYING MEMBER ALONG A SPINNING TUBE IN A TEXTILE SPINNING OR TWISTING OPERATION

BACKGROUND OF THE INVENTION

Ring spinning machines and their operation are well known. Basically, such machines are equipped with a plurality of driven spindles, each of which coaxially supports and drives rotation of a yarn spinning tube, and a ring rail defining a coaxial ring about each spindle with a yarn carrying traveler supported on each ring for delivering yarn to the associated spinning tube. As the spindles are driven to rotate their spinning tubes, the ring rail is reciprocated upwardly and downwardly along the spindles and spinning tubes to apply the yarn carried by each ring traveler to the associated spinning tube to be wound thereabout. To produce a cop-type winding of yarn on the spinning tubes, the ring rail is reciprocated a distance less than the length of the spinning tubes, the extent of the reciprocating motion of the ring rail being incrementally shifted along the spinning tube over the course of the winding operation to wind the yarn about the full length of the spinning tube.

As will be understood, it is desirable in normal practice to operate such a ring spinning machine at as high an operational speed as possible within practical limits, generally determined by the frequency at which yarn breakages occur. Typically, yarn breakages are more frequent during the initial stage of a spinning operation wherein the yarn is being applied in the area of the lower end of the spinning tubes, so that the driven speed of the machine spindles generally must be lower within this initial stage of operation in order to maintain the occurrence of yarn breakages within acceptable limits. Likewise, yarn breakages occur more frequently during the final stages of the winding operation, so that spindle speeds must generally be lowered during this stage of operation as well. During the intervening stage of the spinning operation, however, the spinning machine is normally operated at relatively higher spindle speeds to take advantage of the less frequent occurrence of yarn breakages. In this manner, the ring spinning machine may be operated with the highest overall production speed and greatest practical efficiency while keeping the incidence of yarn breakages within acceptable limits.

It has been recognized that, because of the greater spindle speeds utilized during the intermediate stage of the winding operation performed by a ring spinning machine as abovedescribed, the tension in the yarn being wound correspondingly increases, producing a constriction of the yarn wound along the intermediate portion of each spinning tube. As a result, the yarn occupies a lesser volume on the spinning tubes than the same length of yarn would occupy on a corresponding spinning tube without the tension-related constriction of the yarn and, in turn, the full yarn capacity of the spinning tubes is not realized since additional windings of yarn could be placed in the space left unoccupied by the constricted windings of yarn.

SUMMARY OF THE INVENTION

It is accordingly an object of the present invention to provide an improved spinning method and machine for producing an acceptable cop-type winding of yarn on spinning tubes while achieving an increased capacity of yarn on the tubes without reducing the operational speed of the machine.

According to the present invention, this objective is achieved by equipping a ring spinning machine of the type described, or a like spinning or twisting machine having an incrementally shifted reciprocating yarn-carrying member, with suitable means associated with the shifting arrangement for the ring rail, or other yarn-carrying member, for performing the shifting of the ring rail in relatively shorter increments, i.e. increments of lesser magnitude, during the intermediate stage of the winding operation, while the rotational speed of the spindles is increased, than during the beginning and ending stages of the winding operation, while spindle speeds are decreased. In this manner, a greater yardage of the yarn is wound about the intermediate portion of the length of the spinning tubes than is conventionally achieved, but without exceeding the acceptable volume of yarn on the tubes. Specifically, by shortening the increments by which the reciprocating motion of the ring rail is shifted during the intermediate stage of the winding operation in relation to the increments by which the reciprocating motion of the ring rail is shifted during the beginning and ending stages of the winding operation, a greater quantity of yarn is wound about the spinning tubes during such intermediate stage of winding to occupy the area previously left unoccupied due to tension-imposed constriction of the yarn.

In many instances, it is acceptable, during the intermediate stage of the winding operation, to shorten the increment of shifting of the ring rail in at least one step and then subsequently to increase the increment of shifting of the ring rail in at least one step. However, the greater the number of increment-shortening steps, the greater is the capacity of yarn which can be achieved on the spinning tubes within the acceptable volumetric capacity of the tubes.

According to the improved spinning machine of the present invention, the ring rail drive is equipped with an arrangement for varying the magnitude of the increments in which the ring rail is shifted during the operation of the spinning machine and a control arrangement is associated with the ring rail drive to control the shortening of the shifting increments when the rotational speed of the spindles is increased during the intermediate stage of the winding operation.

In a preferred embodiment, the increment shortening arrangement may include a suitable means for detecting the elevation of the ring rail along the spindles and their spinning tubes for distinguishing the beginning, intervening and ending stages of winding operation. For example, an incremental pulse transmitter or other suitable device may be provided for generating pulses in relation to the distance of travel of the ring rail and a suitable arrangement may be provided for counting the pulses generated during movement of the ring rail in each direction of its reciprocal movement along the spindles and the spinning tubes. An associated means for adjustably establishing differing predetermined numbers of counted pulses for each direction of reciprocal movement of the ring rail determines the actuation of each reversal of the ring rail movement and the increments by which the ring rail is shifted. To shorten the increments by which the reciprocating motion of the ring is shifted during the intermediate stage of the winding operation, the predetermined numbers of counted pulses effective during the intermediate stage of the winding operation have a lesser differential than the predetermined numbers of counted pulses effective during the initial and ending stages of the winding operation.

Alternatively, the increment shortening arrangement may be provided with a timer for determining the elapsed time of winding operation or a spindle speed indicator to distinguish the beginning, intervening and ending stages of the winding operation.

BRIEF DESCRIPTION OF THE DRAWINGS

FIG. 1 is a schematic diagram of a driving and shifting arrangement for the ring rail of a textile ring spinning machine, according to the preferred embodiment of the present invention;

FIG. 2 is a block diagram of a control system for the ring rail drive and shifting arrangement of FIG. 1;

DESCRIPTION OF THE PREFERRED EMBODIMENT

Figure 3:
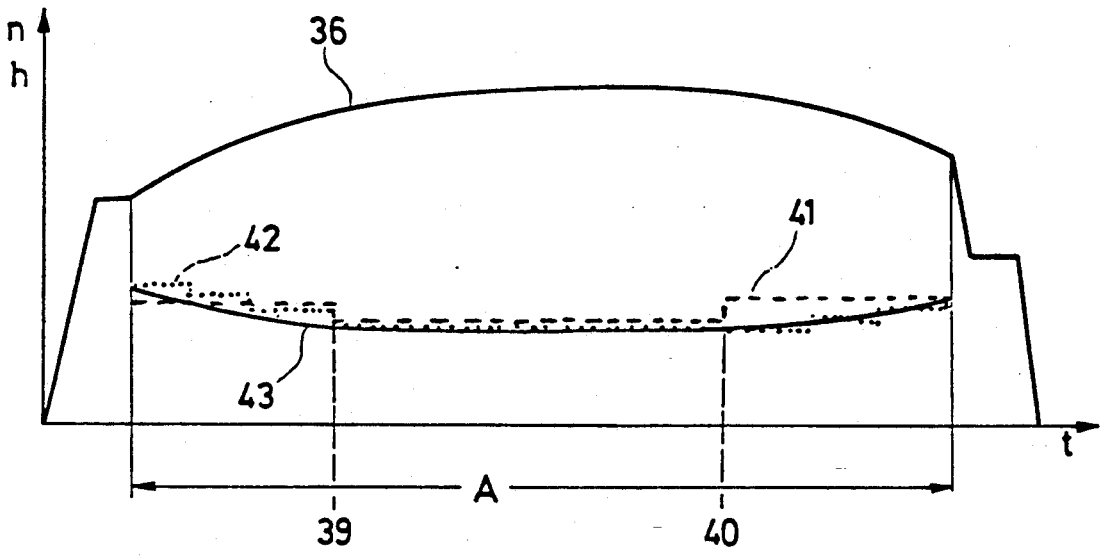
FIG. 3 is a graph representing the change in spindle speed and the corresponding change in ring rail shifting increments over the course of winding operation of a ring spinning machine according to the present invention.

Referring now to the accompanying drawings and initially to FIG. 1, the ring rails at opposite sides of a ring spinning machine are representatively indicated at 10 and 11, and are respectively mounted on vertical drive screws 14,15 by threaded nuts 12,13. Each drive screw 14,15 has a worm gear 16 rigidly affixed thereto in meshing engagement with a respective spiral gear 17 affixed to a shaft 19,20 extending horizontally in the longitudinal direction of the machine and thereby in parallel relation to the ring rails 10,11. As will be understood, the spinning machine includes a plurality of driven spindles arranged along each side of the machine, which have been omitted for sake of clarity and simplification of the drawings. Each spindle coaxially supports a yarn spinning tube for driving rotation thereof. Each ring rail defines a plurality of rings which coaxially encircle the spindles and spinning tubes, with an orbital traveler being supported on each ring for carrying a yarn for winding application to the respective spinning tube.

Each shaft 19,20 is driven from a common drive motor 21 through a reversible gearing transmission 22 having a pair of clutches or like couplings 23,24 which are alternately operable to determine the direction of rotation of the shafts 19,20 and, in turn, determine the upward or downward movement of the ring rails 10,11 along the drive screws 14,15, whereby the ring rails 10,11 may be reciprocably driven upwardly and downwardly by switching operation of the clutches 23,24, engagement of the clutch 23 while disengaging the clutch 24 effecting upward movement of the ring rails 10,11, and engagement of the clutch 24 while disengaging the clutch 23 effecting downward movement of the ring rails 10,11.

According to the present invention, the magnitude of each reciprocal movement of the ring rails 10,11 is detected during the spinning operation and a signal is generated in relation thereto. For this purpose, a high-resolution incremental transmitter 26 is driven by the rotational movement of the shaft 20 through a gear set 25. The incremental transmitter 26 is of the type adapted to emit a high number of pulses in relation to the angular degree of rotation of the transmitter 26.

In addition, another incremental transmitter 27 may be provided to function as an indicator of the elevation of the ring rails 10,11, although it will be understood that such function may also be performed in principle by the incremental transmitter 26. The incremental transmitter 27 is arranged to indicate the absolute position in elevation of the ring rails 10,11 in relation to an initial starting position which serves as a reference, e.g., the lowermost elevation relative to the spindles and spinning tubes assumed by the ring rails 10,11 at the beginning of the winding operation.

The drive of the ring rails 10,11 is controlled through a control device 30, shown schematically in FIG. 2, such that yarn is wound on the associated spindles (not shown) of the spinning machine in a cop-type winding manner, sometimes referred to as filling-type wind, wherein the yarn is wound in a plurality of overlapping conical layers To accomplish this type of yarn winding, the control device 30 is operative to reciprocate the ring rails 10,11 upwardly and downwardly while progressively shifting the extent of the reciprocal motion of the ring rails 10,11 in increments along the drive screws 14,15 and thereby correspondingly along the associated spindles and spinning tubes. For this purpose, the incremental transmitter 26 is operatively connected with counters 28,29 operatively connected independently with a programmable processor 31 which controls operation of the clutches 23,24 through respective clutch actuators 32,33. During upward movement of the ring rails 10,11 with the clutch 23 engaged, the counter 28 counts the pulses emitted by the incremental transmitter 26 and delivers a signal to the processor 31 as soon as a predetermined number of pulses have been reached in the counter 28, whereupon the counter 28 is immediately erased. The processor 31, in turn, disengages the clutch 23 via the clutch actuator 32 to stop upward movement of the ring rails 10,11 and, at the same time, the processor 31 engages the previously disengaged clutch 24 via its clutch actuator 33 to initiate downward movement of the ring rails 10,11. During such downward movement of the ring rails 10,11, the pulses emitted by the incremental transmitter 26 are counted by the counter 29 which is operative to deliver a signal to the processor 31 when a predetermined number of pulses have been received by the meter 29, whereupon the meter 29 is immediately erased. The processor 31 then once again reverses the clutches 23,24 via their clutch actuators 32,33 to again drive the ring rails 10,11 in an upward direction.

A predetermined spinning program is stored in the processor 31, e.g., via a suitable input device (not shown). The program is prepared and designed in accordance with the yarn material to be processed by the spinning machine, the characteristics of the yarn to be spun, and other operational parameters affecting the spinning process. Additionally, the program determines the number of pulses to be counted by the counters 28,29 for actuating reversals of the ring rail movements as above-described. The pulse numbers are predetermined to establish the number of pulses to be counted during upward movement of the ring rails 10,11 to be larger than the number of pulses to be counted during downward movement of the ring rails 10,11, so that a progressive incremental shifting of the elevation of the ring rails 10,11 along their drive screws 14,15, takes place over the course of the winding operation.

The pulses emitted by the incremental transmitter 26 are also fed to a counter 34 which is operative to count such pulses during both upward and downward movements of the ring rails 10,11. The counter 34 is operatively connected to a memory device 35 which is effective to retain its contents in memory even if operating electrical power is terminated to the ring spinning machine, e.g., during a power outage. The memory device 35 is connected to the processor 31 which is operative to obtain the stored number of counted pulses from the memory 35 before resuming the winding operation following any such stoppage of the ring spinning machine. In this manner, the precise point in the spinning program at which the interruption in the machine operation took place can be determined from the pulse number stored in the memory 35. The spinning program can then be continued from precisely this point when the machine is restarted.

The graph of FIG. 3 illustrates the previously-mentioned variation in the speed at which the spindles of the spinning machine are driven over the entire course A of the winding operation in accordance with a predetermined spinning program, in order to maximize the operational speed of the spinning machine while maintaining the incidence of yarn breakages within acceptable limits. The spindles (not shown) are driven from several drive motors via tangential drive belts each of which is arranged in driving relationship with a respective group of multiple spindles. Alternatively, each spindle may be equipped with its own respective drive motor. In all cases, however, a suitable control arrangement, e.g., a frequency controller, is associated with each of the several spindle drive motors to maintain all of the spindles at substantially the same driven speed. In FIG. 3, the curve 36 plots the changing driven speed (n) of the spindles against the elapsed time (t) over the course of the winding operation A. As the curve 36 indicates, the driven speed (n) of the spindles gradually increases during the beginning stage of the winding operation A, remains essentially steadily within a relatively high speed range during the subsequent middle stage of the winding operation A, and then, during the final stage of the winding operation A, gradually reduces but remains within a relatively higher range of driven speeds than during the initial stage of the winding operation A.

Figure 4:
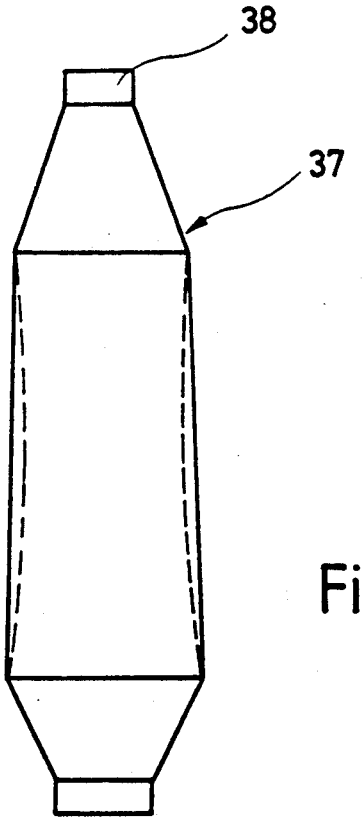
FIG. 4 is a side elevational view of a fully wound yarn spinning tube produced by the ring spinning method and machine of the present invention.

As previously mentioned, when the ring rails 10,11 are shifted in equivalent increments along the spindles, and the spinning tubes thereon, over the course of the winding operation A, the cop thereby produced exhibits a constriction of the yarn wound along the central longitudinal area of the spinning tube, as depicted by the broken lines in the cop 37 of FIG. 4. Such constriction results from the increase in the spindle speeds (n) during the intermediate stage of the winding operation which produces increased tension in the length of the yarn wound about the tube 38 during this winding stage. In turn, the fullest potential yarn capacity of the spinning tube 38 is not realized.

To avoid this problem, the present invention compensates for the constriction of yarn resulting from the increased yarn tension during the intermediate stage of the winding operation A by shortening the increments (i.e. reducing the magnitude of the increments) by which the ring rails 10,11 are shifted along the spindles during the intermediate stage of the winding operation A while the spindles are operating within the higher range of their speeds. In this manner, an additional quantity of yarn is wound about the spinning tube 38 on each spindle during the intermediate stage of the winding operation to occupy the area which otherwise would be left unoccupied by yarn in a conventional winding operation due to the yarn constriction occurring during such intermediate stage of the winding operation. Accordingly, the yarn windings on the cop produced assume the form of the cop 37 shown in solid lines in FIG. 4.

As more fully explained below, such shortening of the increments by which the reciprocating motion of the ring rails 10,11 is shifted along the spindles is accomplished through the controller 30 by programmed changes in the numbers of pulses to be counted by the counters 28,29 in the above-described manner of operation. Specifically, during the intermediate stage of the winding operation, the difference between the predetermined numbers of pulses to be counted by the counters 28,29 is reduced so that the successive layers of yarn windings applied to the spinning tube by reciprocation of the ring rails 10,11 during the intermediate stage of the winding operation are more closely spaced to one another axially along the spinning tube to produce a cop 37 in the solid line form shown in FIG. 4.

The shortening of the increments by which the reciprocating motion of the ring rails 10,11 is shifted along the spindles is diagrammatically depicted in FIG. 3 by the broken line 41. As the broken line 41 indicates, the shortening of the ring rail shifting increments can be accomplished in a single step when the ring rails 10,11 reach a predetermined elevation along the spindles, e.g., as representatively indicated at 39, as a result of the incremental shifting of the ring rails 10,11 during the initial stage of the winding operation.

As previously indicated, the incremental transmitter 27 serves to detect the absolute value of the elevation of the ring rails 10,11 along the spindles and to deliver a corresponding signal to the processor 31. Thus, when the incremental transmitter 27 signals the processor 31 that the ring rails 10,11 have reached the predetermined elevation 39 along the spindles whereat the incremental shifting of the ring rails 10,11 is to be shortened according to the program stored in the processor 31, the processor signals the counters 28,29 to change the respective numbers of pulses they are thereafter to count from the incremental transmitter 26 to reduce the difference between the number of pulses counted by the counters 28 and 29 which, in turn, will be understood to reduce the magnitude by which the reciprocating motion of the ring rails 10,11 is shifted thereafter along the spindles.

Correspondingly, when the incremental transmitter 27 subsequently signals the controller 31 that the ring rails 10,11 have reached a predetermined elevation representing the end of the intermediate stage of the winding operation, the controller 31 signals the counters 28,29 to change the numbers of pulses they are thereafter to count from the pulse transmitter 26 during the remaining final stage of the winding operation to increase the difference therebetween, preferably back to the same number of pulses counted by the counters 28,29 during the initial stage of the winding operation.

As indicated by the broken line 42, it is of course also contemplated to be possible that the shortening of the increments for shifting the reciprocating motion of the ring rails 10,11 may be carried out in multiple stages via several successive changes in the numbers of pulses to be counted by the counters 28,29, which enables the spinning machine to closely approximate an ideal course of change in the incremental shifting of the ring rails 10,11 represented by the solid line 43.

Of course, as those persons skilled in the art will readily recognize, the magnitude of the increments by which the ring rails 10,11 are shifted along the spindles may be changed as a function of other parameters of the spinning operation than the absolute elevation of the ring rails 10,11 as determined by the pulse transmitter 27. For example, the control device 30 may be equipped with a timing element or device connected in association with the controller 31 for initiating changes in the ring rail shifting increments as a function of the elapsed time of the winding operation, since the elapsed time in the winding operation is related to the point at which yarn winding has progressed within the overall course A of the winding operation. Likewise, it is contemplated that the changing speed (n) of the spindles over the course of the winding operation may be monitored by a suitable detector or sensor to provide a corresponding signal to the processor 31 of the control device 30 so that programmed changes in the ring rail shifting increments can be carried out as a function of changes in the spindle speed over the course of the winding operation. Since, in practice, the changes in the speed (n) of the spindles represented by the curve 36 are accomplished in steps, a corresponding stepwise shortening and lengthening of the ring rail shifting increments is accomplished. In each case, the processor 31 accomplishes the change in the ring rail shifting increments by programmed changes in the number of pulses to be counted by the counters 28,29 from the incremental transmitter 26.

Although the present invention has herein been described and illustrated as embodied in a ring spinning machine of the type equipped with ring rails 10,11 which carry orbiting yarn travelers in association with each ring defined by the ring rails 10,11, it will be readily recognized by those persons skilled in the art, and it is accordingly contemplated, that the present invention can be adapted equally well in other types of yarn spinning machines utilizing a reciprocating element which is shifted incrementally along a rotating spindle to wind yarn in a cop-type fashion thereabout, e.g., so-called bell-type or funnel-type spinning machines, flyer-type spinning machines, ring twisting machines, or the like.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a spinning or twisting method wherein yarn is wound in a cop-type winding manner on a spinning tube by the steps of rotating the spinning tube while applying the yarn to the spinning tube by reciprocating a yarn-carrying member along the spinning tube, incrementally shifting the extent of the reciprocating motion of the yarn carrying member along the spinning tube over the course of the winding operation, and varying the rotational speed of the spinning tube to be relatively lower during beginning and ending stages of the winding operation and relatively greater during the intervening stages of the winding operation, the improvement comprising performing the shifting of the yarn-carrying member in relatively shorter increments during the intervening stage of the winding operation than during the beginning and ending stages of the winding operation.

2. The improvement in a spinning or twisting method of claim 1 and characterized further in that said performing step includes shortening the increment of shifting of the yarn-carrying member in a single shortening step between the beginning and intervening stages of the winding operation and subsequently increasing the increment of shifting of the yarn-carrying member in a single increasing step between the intervening and ending stages of the winding operation.

3. The improvement in a spinning or twisting method of claim 2 and characterized further in that said performing step includes timing each change in the increment of shifting of the yarn-carrying member to occur substantially simultaneously with and in inverse relation to a change in the rotational speed of the spinning tube.

4. The improvement in a spinning or twisting method of claim 1 and characterized further in that said performing step includes shortening the increment of shifting of the yarn-carrying member in multiple shortening steps during the beginning stage of the winding operation and subsequently increasing the increment of shifting of the yarn-carrying member in multiple increasing steps during the ending stage of the winding operation.

5. The improvement in a spinning or twisting method of claim 4 and characterized further in that said performing step includes timing each change in the increment of shifting of the yarn-carrying member to occur substantially simultaneously with and in inverse relation to a change in the rotational speed of the spinning tube.

6. In a spinning or twisting machine for winding yarn in a cop-type winding manner on a spinning tube, the machine comprising a spindle for coaxially supporting the spinning tube, means for driving rotation of the spindle and the spinning tube at varying rotational speeds to be relatively lower during beginning and ending stages of the winding operation and relatively greater during the intervening stage of the winding operation, a yarn-carrying member, and means for reciprocating the yarn-carrying member along the spinning tube including means for incrementally shifting the extent of the reciprocating motion of the yarn-carrying member along the spinning tube over the course of the winding operation, the improvement comprising means associated with the shifting means for shortening the increments by which the reciprocating motion of the yarn-carrying member is shifted during the intervening stage of the winding operation in relation to the shifting increments during the beginning and ending stages of the winding operation.

7. The improvement in a spinning or twisting machine according to claim 6 and characterized further in that said increment shortening means comprises means for detecting the elevation of the yarn-carrying member along the spindle and the spinning tube.

8. The improvement in a spinning or twisting machine according to claim 6 and characterized further in that said increment shortening means comprises means for generating pulses in relation to the distance of travel of the yarn-carrying member, means for counting the pulses generated during movement of the yarn-carrying member in each direction of its reciprocal movement along the spindle and the spinning tube, and means for adjustable establishing differing predetermined numbers of counted pulses for each direction of reciprocal movement of the yarn-carrying member for actuating reversal thereof.

9. The improvement in a spinning or twisting machine according to claim 6 and characterized further in that said increment shortening means comprises means for indicating elapsed time of winding operation for distinguishing the beginning, intervening and ending stages of winding operation.

10. The improvement in a spinning or twisting machine according to claim 6 and characterized further in that said increment shortening means comprises means for indicating the speed of the spindle for distinguishing the beginning, intervening and ending stages of winding operation.

* * * * *